US010366558B2

(12) United States Patent
Go et al.

(10) Patent No.: US 10,366,558 B2
(45) Date of Patent: Jul. 30, 2019

(54) CASH BOX AND DEVICE FOR HANDLING NOTES OF VALUE WITH MECHANICAL CODING

(71) Applicant: WINCOR NIXDORF INTERNATIONAL GMBH, Paderborn (DE)

(72) Inventors: Florante Go, Singapore (SG); Kelvin Joon Ho Chow, Singapore (SG); Hengky Wirawan, Singapore (SG); Kan Weng Kit, Singapore (SG); Joerg Plotzitzka, Singapore (SG)

(73) Assignee: Wincor Nixdorf International GmbH, Paderborn (DE)

( * ) Notice: Subject to any disclaimer, the term of this patent is extended or adjusted under 35 U.S.C. 154(b) by 211 days.

(21) Appl. No.: 14/655,756

(22) PCT Filed: Dec. 18, 2013

(86) PCT No.: PCT/EP2013/077055
§ 371 (c)(1),
(2) Date: Jun. 26, 2015

(87) PCT Pub. No.: WO2014/102105
PCT Pub. Date: Jul. 3, 2014

(65) Prior Publication Data

US 2015/0348352 A1 Dec. 3, 2015

(30) Foreign Application Priority Data

Dec. 27, 2012 (EP) ..... 12199432

(51) Int. Cl.
*G07D 11/12* (2019.01)
*G07D 11/16* (2019.01)
(Continued)

(52) U.S. Cl.
CPC ..... *G07D 11/12* (2019.01); *G07D 11/125* (2019.01); *G07D 11/13* (2019.01); *G07D 11/135* (2019.01); *G07D 11/16* (2019.01)

(58) Field of Classification Search
CPC .... G01P 13/00; A47F 5/00; A47F 7/00; F25D 25/02; F25D 25/021; F25D 25/022;
(Continued)

(56) References Cited

U.S. PATENT DOCUMENTS 3,752,359 A * 8/1973 Shaw ..... A61J 7/04 221/5
4,325,494 A * 4/1982 Fish ..... G07D 11/0012 209/534

(Continued)

OTHER PUBLICATIONS

European Search Report dated May 17, 2013.

(Continued)

*Primary Examiner* — Jeffrey A Shapiro
(74) *Attorney, Agent, or Firm* — Black, McCuskey, Souers & Arbaugh, LPA

(57) ABSTRACT

A cash box (18) is provided along with a device (12) for handling notes of value, in which such a cash box (18) is receivable. The cash box (18) has a receiving area (30) for receiving a value note stack and a housing (32) with at least one mechanical coding unit (50) for optional assignment of the cash box (18) to first or second receiving compartments (16) of the device (12). The coding unit (50) has a coding element (60) that is adjustable between first and second positions. The coding element (60) is designed so that the cash box (18) is feedable only to the first receiving compartment (16) when the coding element (60) is in the first position, and only to the second receiving compartment (16) when the coding element (60) is in the second position.

26 Claims, 12 Drawing Sheets

(51) Int. Cl.
*G07D 11/13* (2019.01)
*G07D 11/125* (2019.01)

(58) Field of Classification Search
CPC ..... F25D 25/024; F25D 25/025; A47B 2210/0032; A47B 2088/0474; A47B 2210/00; A47B 2210/01; A47B 2210/0051; A47B 10/0035; A47B 10/004; A47B 88/10; A47B 88/14; A47B 88/18; A47B 88/20; A47B 88/22; A47B 88/02; A47B 88/0451; A47B 88/00; A47B 67/04; A47B 63/00; A47B 96/02; A47B 88/04; A47B 10/10; F16C 2314/72; F16C 29/04; F16C 29/10; F16C 29/02; F16C 29/001; F16C 33/12; F16C 33/121; G07D 11/12; G07D 11/16; G07D 11/006; G07D 11/0021; G07D 11/125; G07D 11/13; G07D 11/135
USPC ..... 384/18, 20–23; 312/333, 334.44, 330.1, 312/350, 351, 334.1, 334.4, 334.7, 334.8, 312/334.45, 334.46, 334.47, 334.11, 312/350.1; 411/213, 109; 194/206, 207, 194/350; 235/379; 209/534
See application file for complete search history.

(56) References Cited

U.S. PATENT DOCUMENTS 5,141,127 A * 8/1992 Graef ..... B65H 1/00 221/198
5,234,209 A * 8/1993 Weigel ..... G07D 11/0009 221/198
5,730,515 A * 3/1998 Ho ..... G11B 33/1493 312/334.7
6,619,766 B1 * 9/2003 Mansueto ..... G06F 1/184 312/223.1
6,935,558 B2 * 8/2005 Washington ..... G06Q 20/1085 235/379
7,520,501 B2 * 4/2009 Lee ..... B65H 1/00 271/149
7,556,259 B2 * 7/2009 Graef ..... B65H 3/5246 271/122
8,033,455 B2 * 10/2011 Graef ..... B65H 1/26 235/379
8,820,314 B1 * 9/2014 Johnson ..... F24C 15/16 126/332
2004/0189284 A1 * 9/2004 Haubold ..... F15L 315/10 324/207.2
2006/0187633 A1 * 8/2006 Huang ..... G06F 1/181 361/679.02
2011/0135227 A1 * 6/2011 Chen ..... A47B 88/0407 384/54
2011/0291539 A1 * 12/2011 Leal ..... A47B 88/10 312/334.44
2012/0032391 A1 * 2/2012 Holland-Letz ..... G07D 11/0012 271/303
2012/0141226 A1 * 6/2012 Jackson ..... F16B 39/08 411/315
2012/0282073 A1 11/2012 Fehrenbach
2013/0075467 A1 * 3/2013 Graef ..... G06Q 20/1085 235/379
2013/0090602 A1 * 4/2013 Avery ..... A61M 5/24 604/189

OTHER PUBLICATIONS

International Search Report dated May 14, 2014.
International Preliminary Report on Patentability—dated Jun. 30, 2015.

* cited by examiner

CASH BOX AND DEVICE FOR HANDLING NOTES OF VALUE WITH MECHANICAL CODING

BACKGROUND

1. Field of the Invention

The invention relates to a cash box comprising a receiving area for receiving a value note stack and a housing. The cash box is designed such that it is receivable in a device for handling notes of value, in particular an automated teller machine, an automatic cash register system and/or an automatic cash safe, in corresponding receiving compartments.

2. Description of the Related Art

For the proper operation of an automated teller machine, an automatic cash safe and/or an automatic cash register system, it is important that a cash box is inserted into the receiving compartment for which it is intended. Since different denominations are received in the different cash boxes, it is important that the cash box is inserted into the receiving compartment that is intended for this denomination so that for the later deposit and/or withdrawal the correct denomination can be fed or removed, respectively.

A known method is that a magnetic coding is provided in that the cash box comprises three or four magnets which are evaluated by means of reed contacts in the receiving compartments of the automated teller machines.

Alternatively, it is also known to provide the cash box with adhesive labels on which the intended receiving compartment or information which makes the manual assignment to the individual receiving compartments possible are written.

These known methods have the disadvantage that it is nevertheless possible to insert the cash box into a wrong receiving compartment. In both cases, the employee of the cash/valuables-in-transit company has to insert the cash box into the receiving compartment indicated on the adhesive label or the display. Such a process is error-prone by nature. In addition, the component parts required for the magnetic coding are cost-intensive.

It is an object of the invention to specify a cash box and a device for handling notes of value in which it is guaranteed in an easy manner that a cash box is inserted into the intended receiving compartment.

SUMMARY OF THE INVENTION

A cash box according to this disclosure comprises a mechanical coding unit arranged at the housing and used for the optional assignment of the cash box to a first receiving compartment of a device for handling notes of value or to at least a second receiving compartment of this device. The coding unit has a coding element which is adjustable between a first and at least a second position, the coding element being designed such that the cash box is only feedable to the first receiving compartment when the coding element is arranged in the first position and such that the cash box is only feedable to the second receiving compartment when the coding element is arranged in the second position.

Such a mechanical coding has the advantage that each cash cassette can only be inserted into the predetermined receiving compartment since the insertion into any other receiving compartment is mechanically blocked. Thus, an employee of a cash/valuables-in-transit company would immediately notice when he/she inadvertently wants to insert the cash box into a wrong receiving compartment and could immediately rectify this error. In addition, such a mechanical coding can be realized much more cost-efficiently and does not require any energy supply as compared to an electrical coding by means of a memory element and a display.

The coding element may be designed such that an insertion of the cash box into a receiving compartment other than the first receiving compartment is mechanically prevented when the coding element is arranged in the first position. The coding element is in particular designed such that an insertion of the cash box into a receiving compartment other than the second receiving compartment is mechanically prevented when the coding element is arranged in the second position. Thus, the insertion of the cash box into a wrong receiving compartment is prevented easily.

The housing of the cash box may have at least one recess by means of which the cash box can be held in the corresponding receiving compartment on rails of the receiving compartments which are complementary to this recess so that via the engagement of the rails in the recess a predetermined relative positioning of the cash box in the respective receiving compartment is accomplished. By way of this predetermined positioning between the cash box and the receiving compartment also the position of the coding element in the first or in the second position relative to the receiving compartment is predetermined so that by means of correspondingly arranged counter elements in the receiving compartments an insertion can be prevented easily.

The coding element may comprise a pin. A first receiving element for insertion of this pin and at least a second receiving element for insertion of this pin may be provided in the housing of the cash box, wherein in the first position the pin is inserted into the first receiving element and projects therefrom at least in part and in the second position the pin is inserted into the second receiving element and projects therefrom at least in part. In this way, the position of the pin can easily be changed so that the cash box can each time be adapted to the intended receiving compartment prior to its respective insertion.

A third and a fourth receiving element for receiving the pin may be provided in the housing, wherein the pin is arranged in a third position when it is inserted into the third receiving element and is arranged in a fourth position when it is inserted into the fourth receiving element. The cash box is only feedable to a third receiving compartment of the device when the pin is arranged in a third position and is only feedable to a fourth receiving compartment of the device when the pin is arranged in a fourth position. Thus, four different positions can easily be classified by means of the mechanical coding element and thus an assignment to four different receiving compartments can be accomplished. Since most of the automated teller machines comprise exactly four receiving compartments for receiving at least one cash box, thus an unambiguous precise assignment can be accomplished.

The receiving elements may be arranged along a straight line so that a particularly simple structure of the cash box and also a particularly simple arrangement of the stops of the individual receiving compartments is possible.

In an alternative embodiment, the coding element can also comprise not only the one pin, referred to hereinafter as first pin, but at least a second pin. When the coding element is arranged in the first position, the second pin is arranged in the second receiving element, and when the coding element is arranged in the second position, it is arranged in the third receiving element. When the coding element is arranged in the third position, then the second pin is arranged in the fourth receiving element. When the coding element is arranged in the fourth position, then the second pin is inserted into the first receiving element. In a fifth position, the first pin is inserted into the first receiving element and the second pin is inserted into the third receiving element. In the sixth position, the first pin is inserted into the second receiving element and the second pin is inserted into the fourth receiving element. By using two pins thus in the case of four receiving elements six different codings can be achieved so that accordingly a higher number of different codings is possible and by using two pins cash boxes with four receiving elements can unambiguously be assigned to the receiving compartments also in automated teller machines having six compartments.

Alternatively, also more than four receiving elements and/or more than two pins can be used. In this way, the number of the different possible codings can be adapted to the respective number of receiving compartments.

One coding possibility each may be used for one received denomination, i.e. that, if the same denomination is to be received in two receiving compartments of an automated teller machine, the same coding is used for both receiving compartments. Thus, in this case, in both cash boxes which contain the same denomination the pins or the pin is inserted into the same receiving elements or the same receiving element.

The first receiving element, the second receiving element, the third receiving element and/or the fourth receiving element each may comprise a through hole in the wall in the cash box, an end section of the pin may project through this through hole and into the interior of the cash box when the pin is inserted into the respective through hole.

A locking element may be arranged at the end section of the pin projecting into the interior in the assembled state and prevents the removal of the pin from the respective receiving element. The assembled state is defined as the state in which the pin is inserted into the respective receiving element and the cash box is prepared for its use. The locking element ensures that the pin cannot be inserted from one receiving element into another one by an unauthorized person. The locking element can only be removed by a person having access to the interior of the cash box, i.e. having the authorization to open the cash box. Thus, in particular the positioning of the pin and thus the assignment to one of the receiving compartments can only be changed prior to the use of the cash box, for example in a cash center.

The pin may comprise a groove in its end section, the locking element being designed as a locking ring which is arranged in the groove. Thus, a particularly simple structure is achieved and the locking element can be re-mounted non-destructively as often as desired.

The pin mat be designed such that it comprises a first section with a first diameter and a second section with a second diameter, the second diameter being smaller than the first diameter. The second section is at least in part arranged within the through hole when the pin is inserted into the corresponding receiving element. The first diameter, on the other hand, is larger than the diameter of the through hole so that the first section of the pin projects at least in part from the outer wall of the housing. Thus, by means of the stepped structure of the pin a predetermined positioning is guaranteed.

The mechanical coding unit may be a first coding unit, and the cash box may comprise at least a second mechanical coding unit that may be constructed identically to the first coding unit. This second coding unit may be arranged at an opposite side of the housing. Thus, a particularly reliable coding is guaranteed.

A further aspect of the invention relates to a device for handling notes of value. The device may have a first receiving compartment for receiving a cash box as described above and at least a second receiving compartment for receiving a cash box as described above. In the first receiving compartment a first stop is provided against which the coding element hits in an attempt of inserting the cash box into the first receiving compartment provided that the coding element is arranged in a position other than the first position so that the cash box cannot be inserted into the first receiving compartment when the coding element is arranged in a position other than the first position. In the second receiving compartment a second stop is provided against which the coding element hits in an attempt of inserting the cash box into the second receiving compartment when the coding element is arranged in a position other than the second position so that the cash box cannot be inserted into the second receiving compartment when the coding element is arranged in a position other than the second position. Thus, it is easily guaranteed that the cash box can only be mechanically inserted into the intended receiving compartment each time. Thus, the coding is visible from both sides. Further, the number of the different possible codings can easily be increased in this way in that the coding elements are arranged in different positions at both sides.

The first and the second stop each may be designed in the form of an element projecting into the receiving area of the respective receiving compartment, the first stop having a first recess and the second stop having a second recess. The first recess may be designed such that the cash box is insertable into the first receiving compartment when the coding element is arranged in the first position in that the coding element is movable through the first recess of the first stop when the cash box is inserted into the first receiving compartment. Accordingly, the second recess is designed such that the cash box is insertable into the second receiving compartment when the coding element is arranged in the second position in that the coding element is moved through the second recess of the second stop when the cash box is inserted into the second receiving compartment.

In an alternative embodiment, the stops may not be formed as elements with recess but instead be formed by means of bent sheets. For this, the first stop and the second stop may each comprise a first and at least a second sheet that are designed such that at least a portion thereof projects into the receiving compartment so that a wrong cash box, i.e. a cash box which is not intended for the respective receiving compartment cannot be inserted since at least one of the pins arranged in the receiving elements of the cash box would hit against the portion of at least one sheet of the respective stop projecting into the receiving compartment and would prevent the insertion of the cash box.

The two sheets of the stop can be arranged in different positions relative to each other so that correspondingly free recesses between them and/or above or below them may result through which the pins can be passed when a cash box is inserted into the respective receiving area so that the cash box can be inserted and in doing so is not impeded by the sheets provided that the cash box is coded correspondingly correctly.

The walls of the first receiving compartment and of the second receiving compartment each may have a recess, wherein the first sheet and the second sheet are mounted to the wall at the side of the wall facing away from the receiving compartment and project into the respective receiving compartment through the recess. This has the advantage that the sheets can be mounted easily and a particularly simple design of the sheets is possible.

The sheets can in particular be screwed or riveted to the wall. The provision of a screw connection has the advantage that the sheets can be disconnected again when their position within the recess is to be changed so that cash boxes coded differently can be inserted. The riveting, on the other hand, has the advantage that the connection is permanent and is difficult to be disconnected.

In particular, a predetermined number of holes through which the rivets or the screws can be passed for mounting the sheets may be provided in the wall of each receiving compartment. By means of the holes various predetermined positions are defined at which the sheets can be mounted. Depending on the position in which a sheet is arranged or not, it is defined which cash boxes can be inserted. For this, in particular the positions for mounting the sheets and the receiving elements in which the pins can be arranged are adapted to each other so that a cash box can only be inserted into the respective receiving area when in all positions in which a sheet is arranged in the receiving compartment no pin is inserted into the respective receiving element.

The number of different predetermined positions for mounting the sheets for each receiving compartment may be equal to the number of the receiving elements for receiving the pins per cash box. In particular, four positions for receiving sheets are defined, for which preferably eight holes are provided which are arranged at two different sides of the recess oppositely to each other so that the sheets can be mounted on both sides. In this embodiment, the intended cash box in particular comprises four receiving elements in which the pins can be arranged.

Two sheets per receiving compartment may be provided and may be arranged in different ones of the four predetermined positions in accordance with the cash boxes to be received. In this embodiment, in particular cash boxes are used that comprise four receiving elements in which two pins are received in accordance with the desired coding.

Compared to the use of different stops per receiving compartment that have correspondingly different recesses and projections, the use of sheets which can be arranged at different positions has the advantage that for all receiving compartments the same sheets can be used and these, similar to the way of coding of the cash boxes by means of the pins, just have to be arranged in different positions. Thus, the required variety of parts is reduced.

In addition, such sheets offer a particularly simple and stable form so that even when the cash box is inserted with much force these cannot be damaged so easily.

The sheets may be made of a metal so that the stability of the stops is further increased.

The first stop is mounted to a wall of the first receiving compartment, at the first stop of the wall of the first receiving compartment a seal being provided by means of which a change of the position of the first stop relative to the wall of the first receiving compartment can be determined. Accordingly, it is advantageous when the second stop is mounted to a wall of the second receiving compartment and when at the second stop and the wall of the second receiving compartment likewise a seal is provided by means of which a change of the position of the second stop relative to the wall of the second receiving compartment can be determined. Preferably in all receiving compartments, the stops are arranged in the same relative position with respect to the respective receiving compartment, wherein for the different coding different stops are used in the individual receiving compartments.

By means of the seals it is guaranteed that the position of the stops cannot be changed in an unnoticed manner so that the mechanical coding cannot be circumvented.

The seal can, for example, be designed in the form of an adhesive label, a plastic cable and/or a lead seal which are designed such that when the position of the stop relative to the wall is changed they are destructed in a visible manner.

The seal may comprise a predetermined breaking point so that the destruction is visible in a predetermined way when the position between stop and wall is changed. Here, the adhesive label in particular has a perforation.

In the embodiment with several sheets per receiving compartment, the seal may be designed such that both the sheets and the wall of the respective receiving compartment have slots through which the plastic cable can be passed. In particular, a plastic cable may be used that is passed through all sheets of the corresponding stop and the wall. Alternatively, for each sheet also an own cable can be used for sealing. Alternatively, also in the embodiment with the several sheets, perforated adhesive labels can be used for sealing, here preferably an own adhesive label being used for each sheet, which label is partly adhered to the sheet and partly to the wall. Here, the adhesive labels are designed such that they cannot be removed from the wall and the sheet in a non-destructive manner.

A further aspect relates to an arrangement that comprises a device according to the above-described type and at least one above-described cash box that is received in the first receiving compartment of the device.

Further features and advantages of the invention result from the following description which explains the invention in more detail on the basis of embodiments in connection with the enclosed Figures.

DETAILED DESCRIPTION

Figure 1:
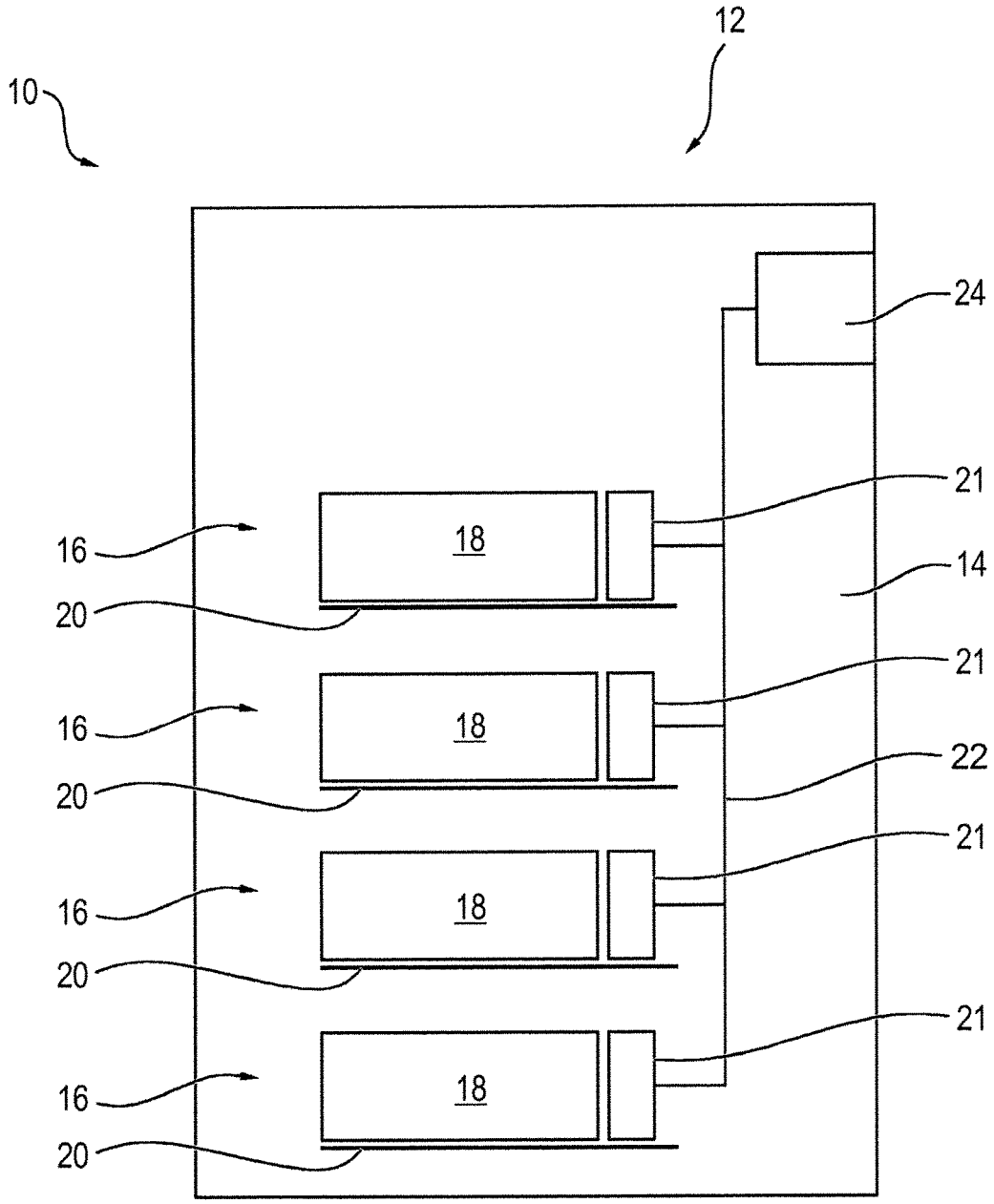
FIG. 1 shows an arrangement with a device for handling notes of value and four cash boxes.

In FIG. 1, a schematic illustration of an arrangement 10 comprised of a device for handling notes of value and four cash boxes 18 is illustrated. The device 12 is in particular an automated teller machine, an automatic cash register system and/or an automatic cash safe.

The device 12 comprises a box receiving area 14 in which four receiving compartments 16 for receiving one cash box 18 each are provided. Each receiving compartment 16 comprises a rack 20 by means of which the cash box 18 is held in the respective receiving compartment 16. In addition, a separating and/or stacking module 21 by means of which notes of value can be fed to and/or removed from the respective cash box 18 is provided in each receiving compartment 16. The notes of value are transported along a transport path 22 between an input and/or output compartment 24 for the input and/or output of notes of value and the separating and/or stacking modules 21.

Figure 2:
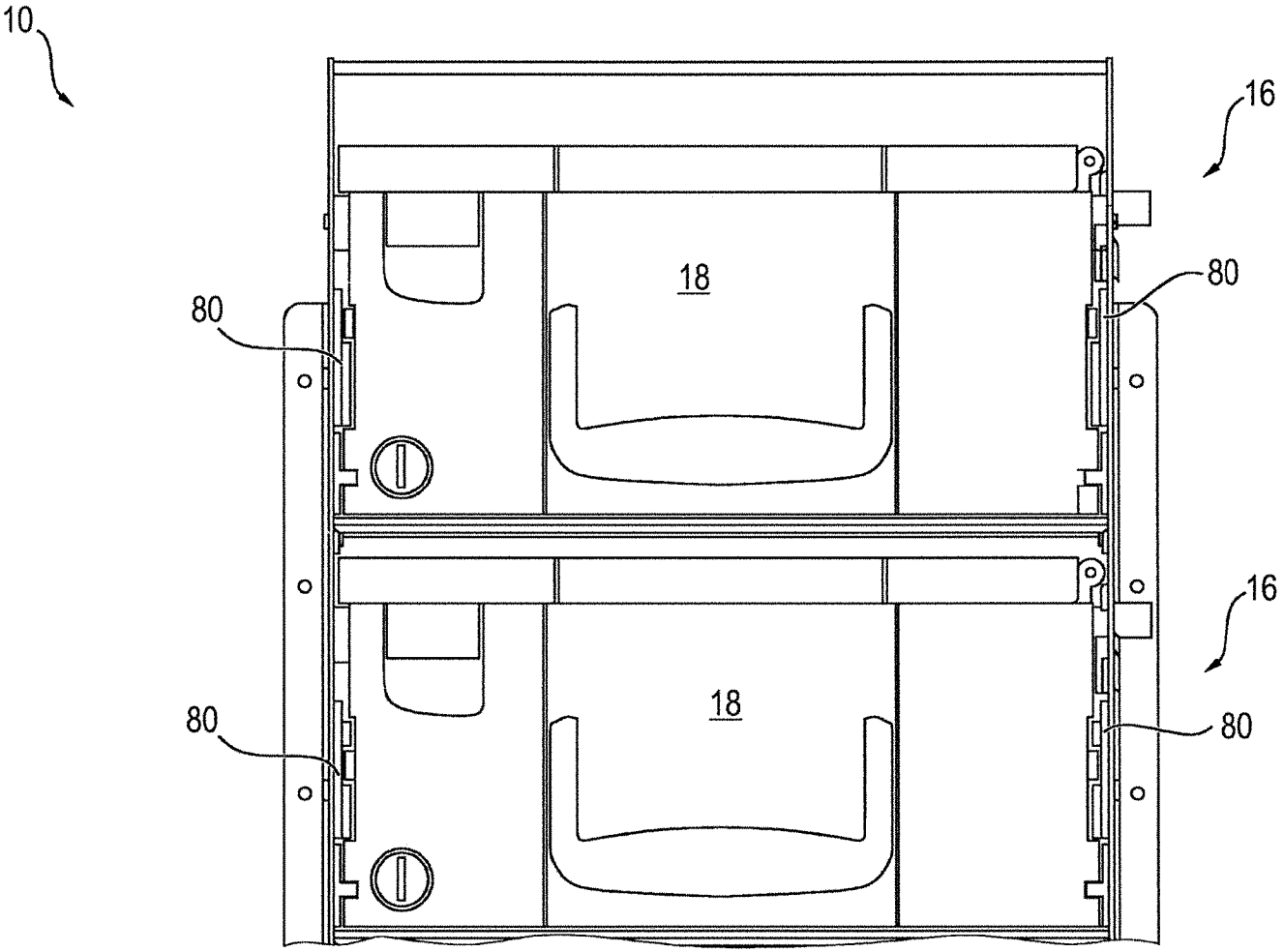
FIG. 2 shows a schematic illustration of a detail of the arrangement according to FIG. 1.
Figure 3:
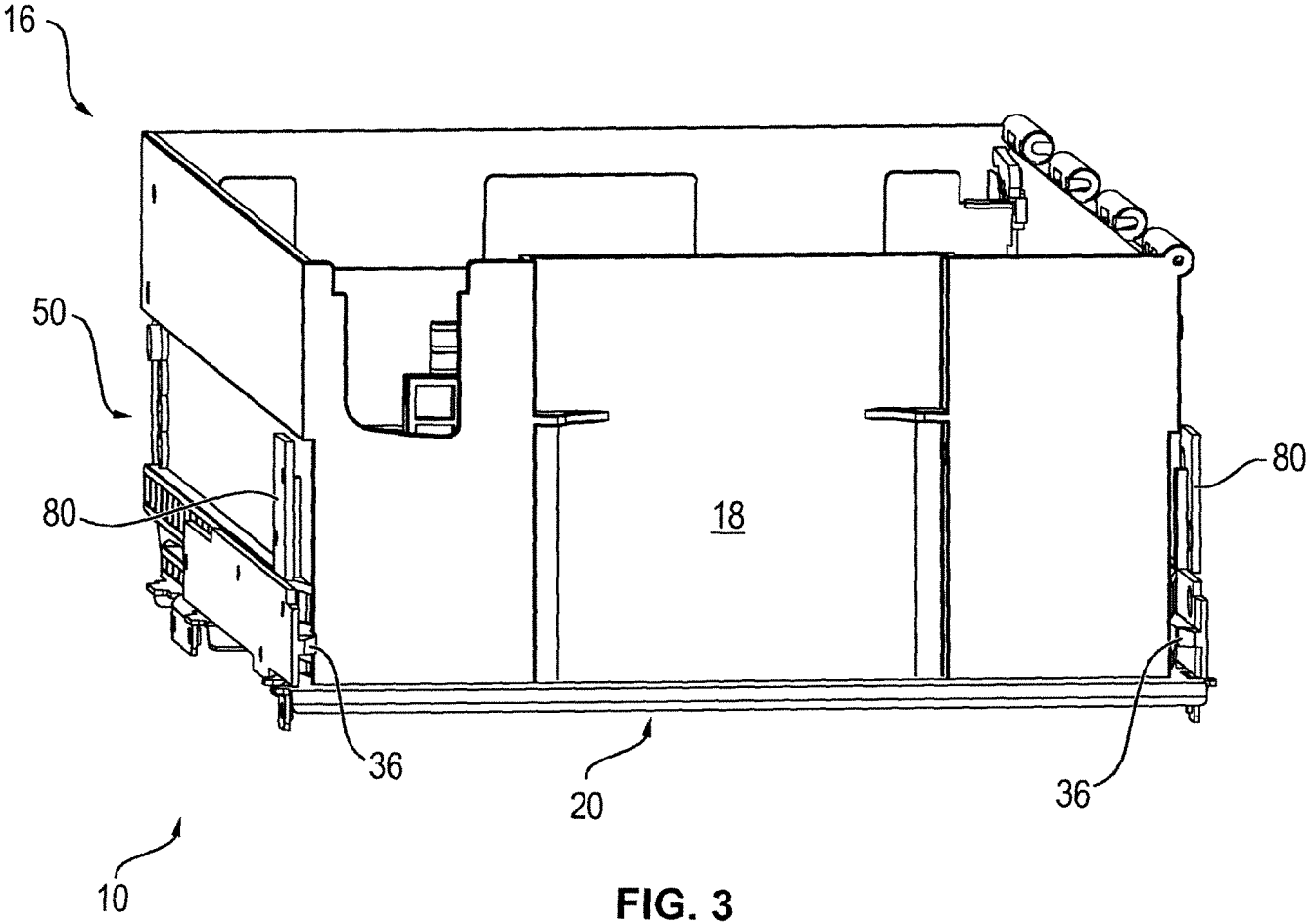
FIG. 3 shows a further detail of the arrangement according to FIG. 1.
Figure 4:
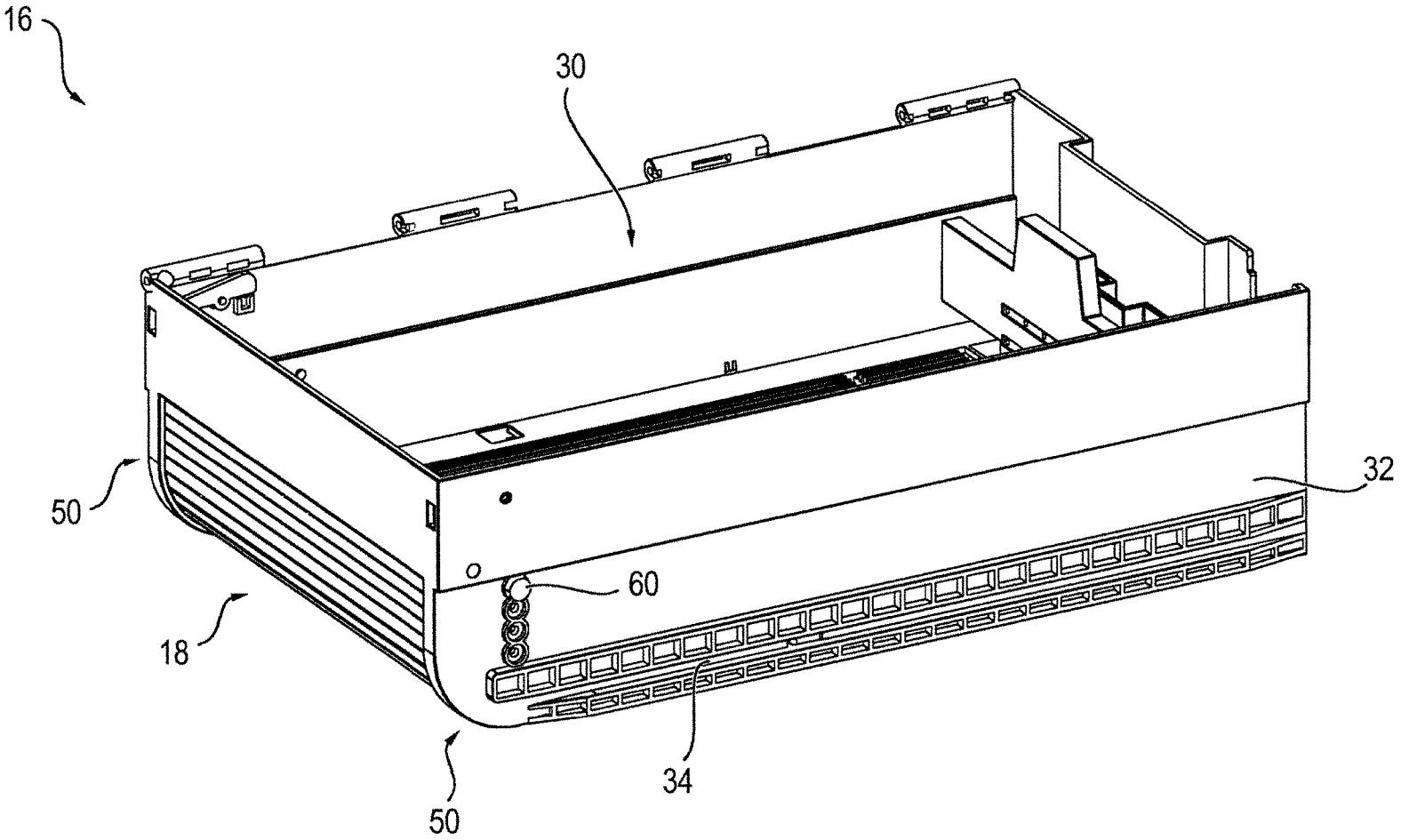
FIG. 4 shows a schematic perspective illustration of a cash box.

In FIG. 2, a schematic illustration of a detail of the arrangement 10 according to FIG. 1 is illustrated, only the two upper receiving compartments 16 being shown. FIG. 3 shows a schematic perspective illustration of a further detail of the arrangement 10 according to FIG. 1, merely the uppermost receiving compartment 16 and the cash box 18 received therein being shown. FIG. 4 shows a schematic perspective illustration of the cash box 18, a cover of the cash box 18 not being illustrated for a better visibility of the inner component parts. The cash box 18 comprises a receiving area 30 for receiving a value note stack and a housing 32. At both sides of the housing 32, recesses 34 are provided in which complementary projections 36 of the rack 20 of the respective receiving compartment 16 are received when the cash box 18 is inserted into the corresponding receiving compartment. In this way, the cash box 18 is held in the receiving compartment 16 and a relative predetermined positioning between the cash box 18 and the receiving compartment 16 is achieved.

So that the cash box 18 can only be received in the receiving compartment 16 of the device 12 for which it is intended, two mechanical coding units 50 are provided on the cash box 18, in FIG. 4 only one of these two mechanical coding units 50 being visible. The second coding unit 50 is in particular arranged at the opposite side of the housing and is constructed identically to the first coding unit 50 so that hereinafter only the first coding unit 50 is described in more detail.

Figure 5:
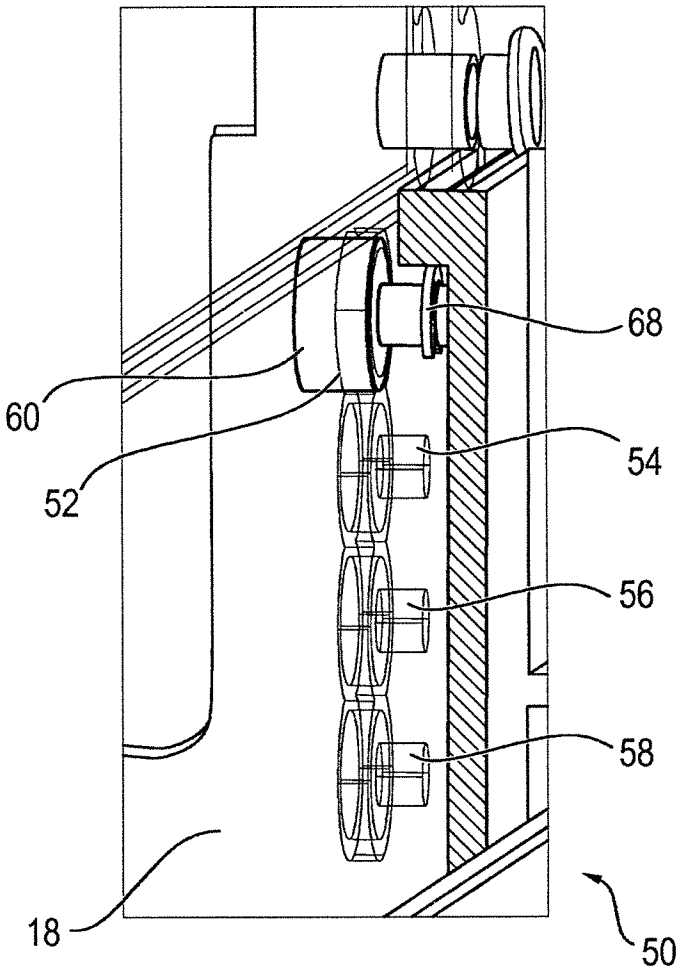
FIG. 5 shows a schematic perspective illustration of a detail of the cash box according to FIG. 4.
Figure 6:
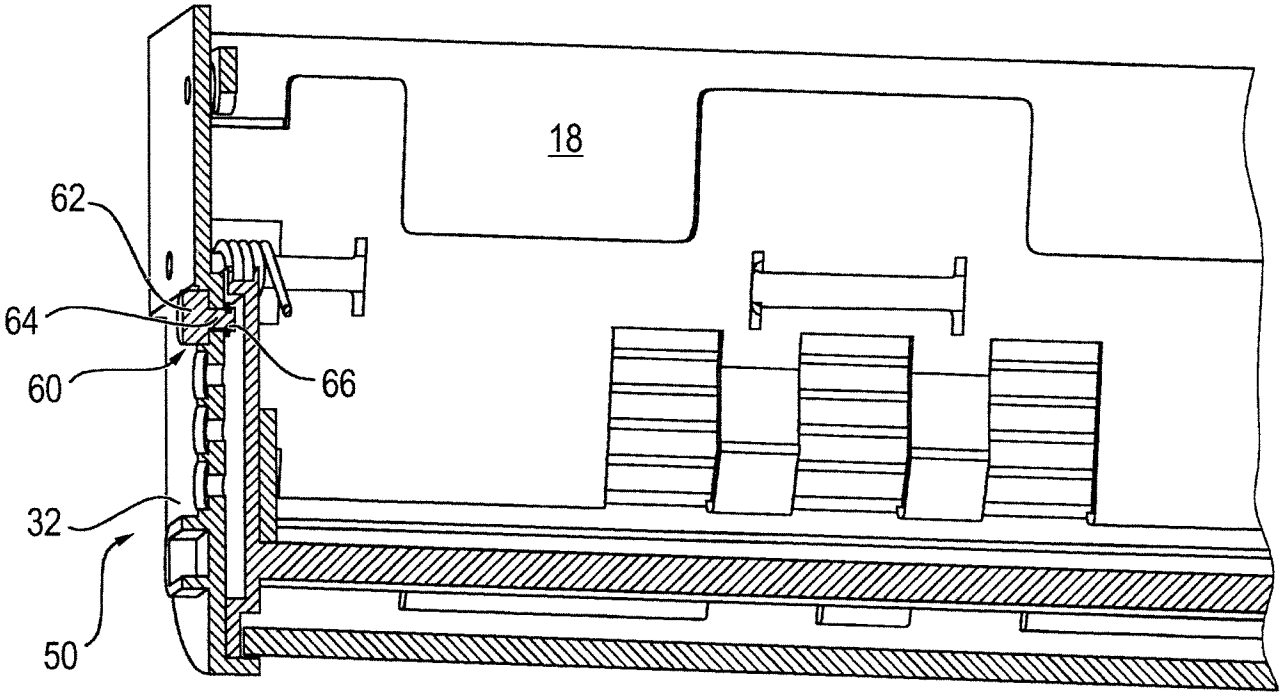
FIG. 6 shows a sectional view of the cash box according to FIGS. 4 and 5.

In FIG. 5, a detail of the cash box 18 is illustrated, the area of the coding unit 50 being drawn to a larger scale here. FIG. 6 shows a sectional view of the cash box 18, the section line running centrally through the coding unit 50 so that its structure is well visible.

The coding unit 50 comprises four receiving elements 52 to 58 and a pin 60 which can optionally be inserted into one of these four receiving elements 52 to 58. The receiving elements 52 to 58 are in particular designed in the form of a stepped through hole.

The pin 60 comprises a first section 62 and a second section 64, the diameter of the first section 62 being larger than the diameter of the second section 64 and the diameter of the second section 64 in particular corresponds to the smaller part of the through hole. For assembly, the pin 60 is inserted into the corresponding receiving element 52 to 58 from outside so that the shoulder between the first section 62 and the second section 64 rests against the wall. The second section 64 is designed such that it projects at least in part into the interior of the cash box 18.

A groove 66 in which a locking ring 68 can be arranged is provided in the end portion of the second section 64 of the pin 60 projecting into the interior. When mounting the pin 60 in the respective receiving element 52 to 58, this locking ring 68 is mounted from the inside of the cash box 18 so that the pin 60 cannot be removed again from the respective receiving element 52 to 58 by an unauthorized person having no access to the interior of the cash box 18. Thus, the coding of the cash box 18, i.e. the assignment of the cash box 18 to one of the receiving compartments 16, is accomplished during the configuration of the cash box 18, for example in a cash center.

On the other hand, however, such a locking ring 68 also makes it possible that the position of the pin 60 can be changed by an authorized person, i.e. a person having access to the interior of the cash box 18 so that the cash box 18, depending on the required situation, can be adapted to the corresponding receiving compartment 16 in which it is to be received.

The first section 62 is designed such that it projects outwardly at least in part from the wall of the cash box 18. In the receiving compartments 16, one stop 80 each is provided on both sides of the receiving compartment 16, these stops 80 being designed such that each time only one cash box which is intended for this receiving compartment 16 by means of the corresponding mechanical coding can be inserted into the receiving compartment 16, and cash boxes 18 the pins 60 of which are not arranged in the corresponding position are mechanically prevented from being inserted.

Figure 7:
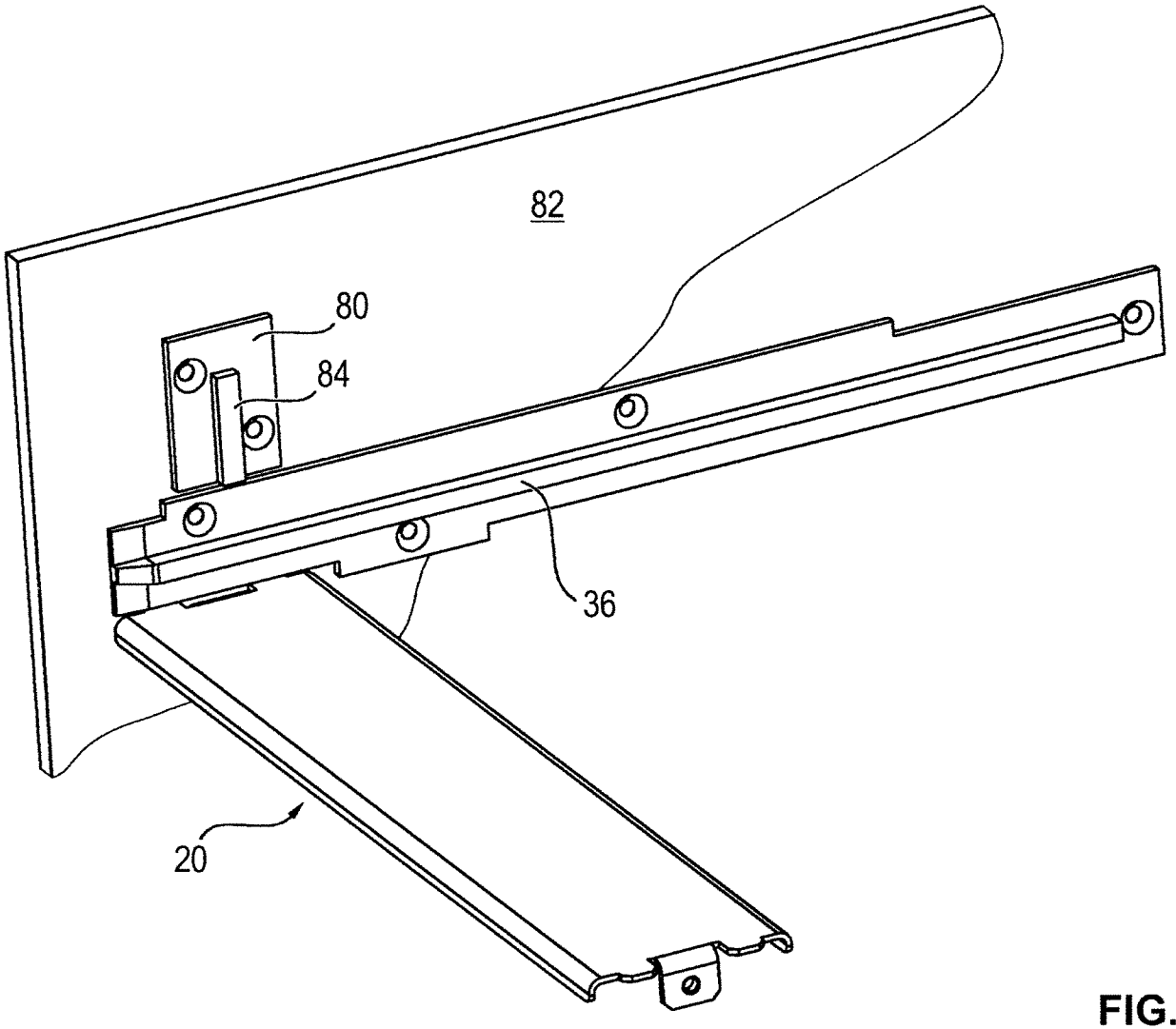
FIG. 7 shows a schematic perspective illustration of a detail of a receiving compartment of a device for handling notes of value according to a first embodiment.
Figure 8:
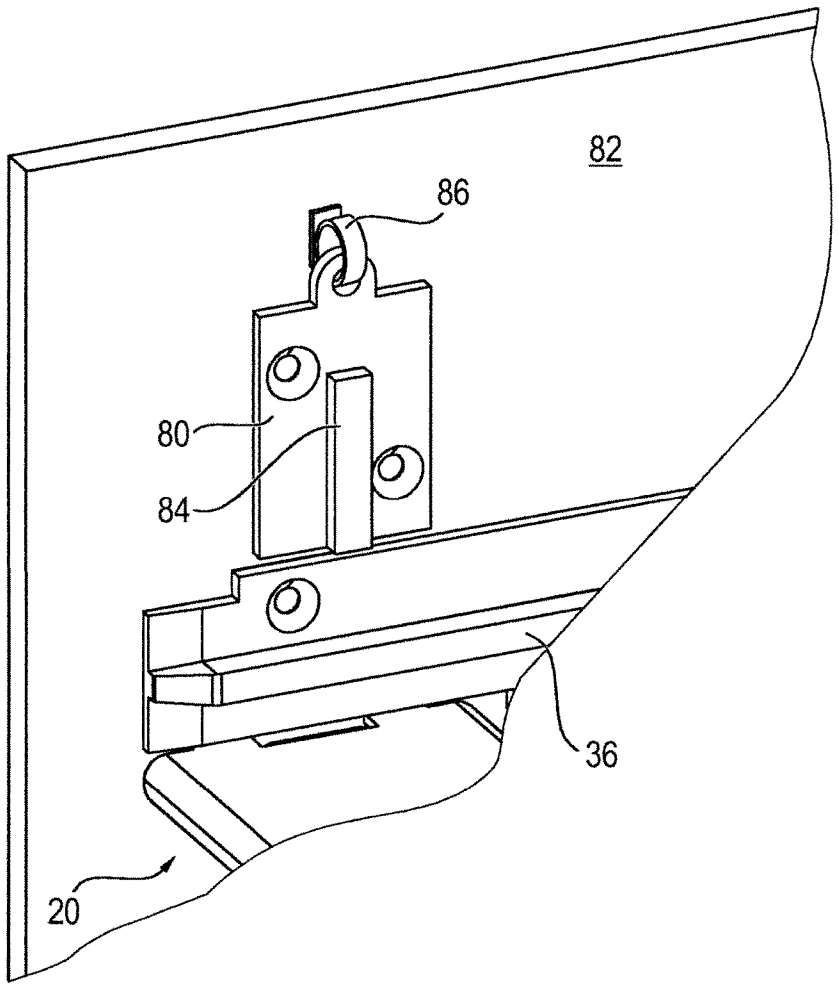
FIG. 8 shows a schematic perspective illustration of a detail of a receiving compartment according to a second embodiment.
Figure 9:
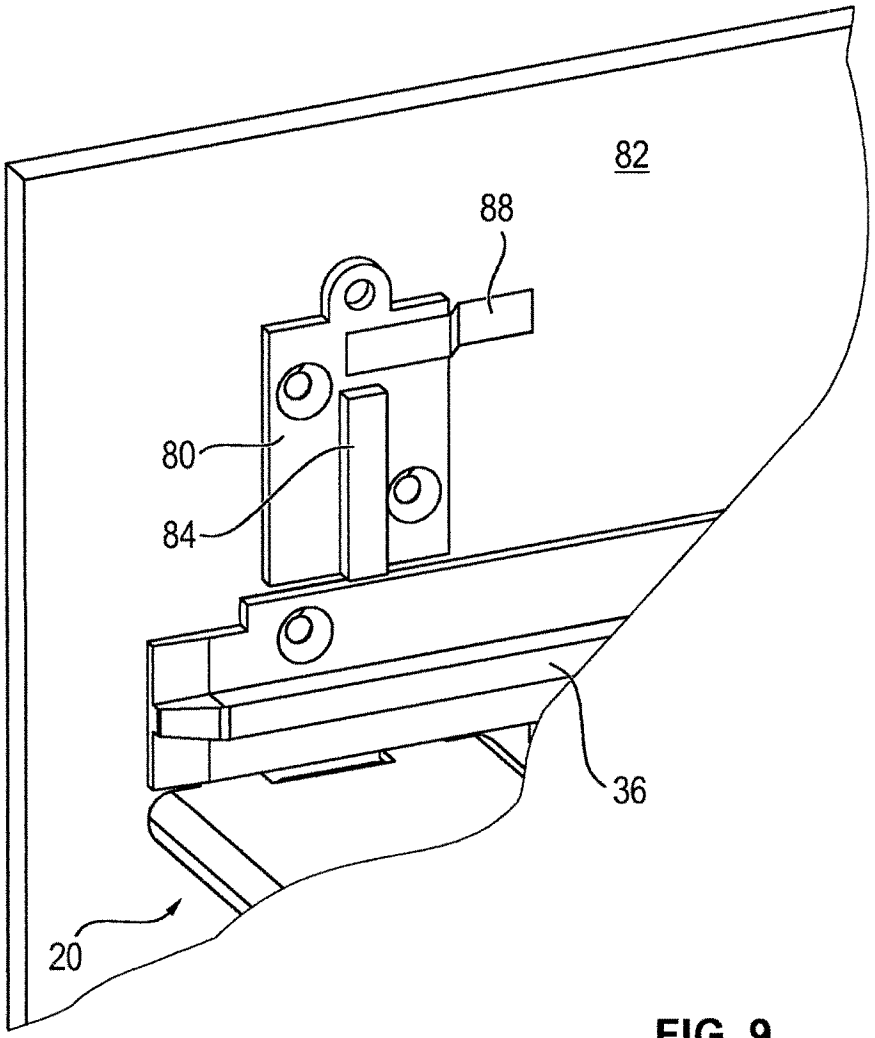
FIG. 9 shows a schematic perspective illustration of a detail of a receiving compartment according to a third embodiment.

In FIG. 7, a first embodiment of such a stop 80 is illustrated, in FIG. 8 a second embodiment is illustrated and in FIG. 9 a third embodiment is illustrated.

The stop 80 is in particular mounted to the wall 82 of the respective receiving compartment 16 and has a projecting element 84 which projects into the receiving area of the receiving compartment 16 in which the cash box 18 is arranged. This projecting element 84 is designed differently each time with respect to the stops 80 of the respective receiving compartments 16. The projecting elements 84 of the first receiving compartment 16 are designed such that only cash boxes 18 in which the pin 60 is arranged in the first receiving element 52, such as shown in FIG. 4, can be inserted into the first receiving compartment. When the pin 60 is arranged in the first receiving compartment 52, the pin 60 is moved above the projecting element 84 when the cash box 18 is inserted, as this is shown in FIG. 2. When the pin 60 is, on the other hand, arranged in one of the other receiving elements 54 to 58, it would hit against the projecting element 84 in an attempt of inserting the cash box into the first receiving compartment 16 and thus would prevent an insertion into this receiving compartment 16.

The projecting element 84 of the second receiving compartment 16, on the other hand, is designed such that only a cash box 18 in which the pin 60 is arranged in the second receiving element 54, as shown in FIG. 2, can be inserted into this receiving compartment 16. In this case, the pin 60 is moved through the recess of the projecting element 84. When, on the other hand, the pin is arranged in one of the other receiving elements 52, 56, 58, the pin 60 hits against the projecting element 84 in an attempt of inserting the cash box 18 into the second receiving compartment 16 so that an insertion is mechanically prevented.

Accordingly, also the stops of the third receiving compartment 16 and of the fourth receiving compartment 16 are designed such that a cash box 18 can only be inserted into the third receiving compartment 16 when the pin 60 is arranged in the third receiving element 56, and can only be inserted into the fourth receiving compartment 16 when the pin 60 is inserted into the fourth receiving element 58.

Thus, a simple mechanical coding of the cash box 18 is accomplished and thus a simple reliable assignment to the respective receiving compartments 16. In particular, thus manual errors are prevented since an insertion is only possible into the respective intended receiving compartment 16 and an attempt of inserting the cash box into one of the other receiving compartments 16 is mechanically prevented.

In the second embodiment shown in FIG. 8, a plastic cable 86 is provided by means of which the stop 80 is connected to the wall 82 and which is designed such that it is irreversibly destructed when the position of the stop 80 relative to the wall 82 is changed. Thus, a change of the position can be traced in an easy manner so that manipulation attempts are prevented.

In the third embodiment according to FIG. 9, instead of the plastic cable 86 an adhesive label 88 is provided which is adhered to the stop 80 and the wall 82 and which would likewise be destructed when the position between the stop 80 and the wall 82 is changed. For this, the adhesive label 88 in particular comprises a predetermined breaking point.

Alternatively, also forms of a sealing other than a cable 86 or an adhesive label 88 can be used.

Figure 10:
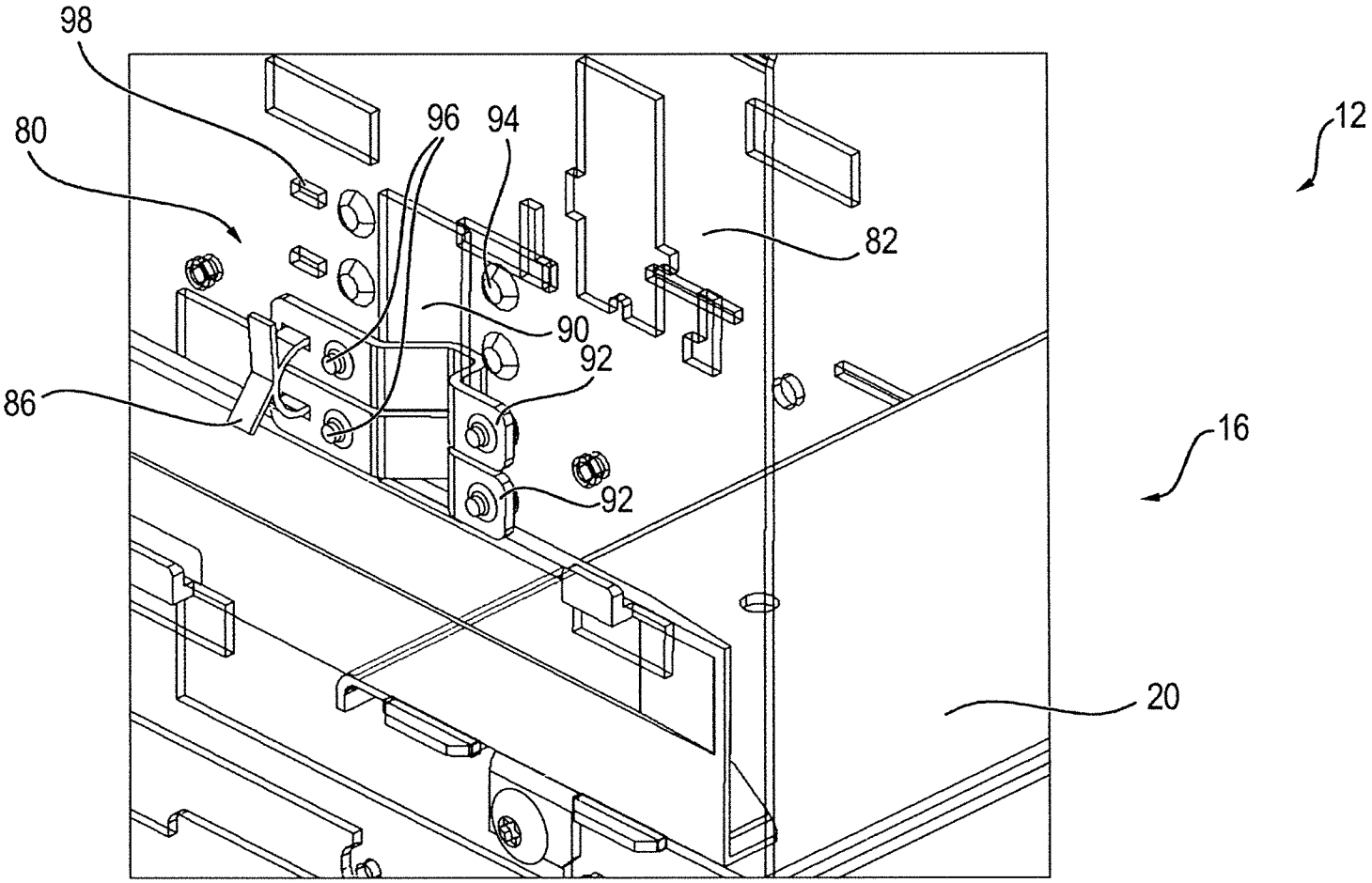
FIG. 10 shows a schematic perspective illustration of a detail of a receiving compartment according to a fourth embodiment.

In FIG. 10, a schematic perspective illustration of a detail of a receiving compartment 16 according to a fourth embodiment is illustrated. In this embodiment, not a single element is used as a stop 80, the form of which, i.e. in particular its projections and recesses, are adapted to the respective receiving compartment 16 but two sheets 92 are used as a stop 80.

In the wall 82 of the receiving compartment 16 a recess 90 is provided for this. Further, the wall 82 has eight holes, one of which being exemplarily identified with the reference sign 94. Here, each time four of the holes 98 are arranged opposite to each other on opposite sides of the recess 30. By means of these holes 94, each of the sheets 92 can be arranged at four different positions. In the embodiment shown in FIG. 10, the two sheets 92 are arranged in the two lowest positions.

The sheets 92 are each time bent such that a portion thereof projects through the recess 90 into the receiving compartment 16 and thus forms a projection against which a pin 60 would hit when a cash box 18 is inserted, provided that the coding of this cash box 18 is not adapted to the receiving compartment 16, i.e. that one of the pins 16 is arranged in one of those receiving elements 52 to 58 that corresponds to a position in which one of the sheets 92 is arranged.

Here, the cash boxes 18 and the receiving compartments 16 are adapted to each other such that during the insertion of a cash box 18 by means of the lateral rails each time one of the receiving elements 52 to 58 is guided in the area of one of the positions for the sheets 92 predetermined by means of the holes 94. Depending on in which of the four positions the sheets 92 are arranged, six different coding possibilities can be set. In this way, it is defined in which receiving element 52 to 58 the pins 60 have to be arranged so that the cash box 18 can be inserted.

The sheets 92 are in particular mounted to the wall 82 by means of mounting elements 96 which project through the corresponding holes 94 and the corresponding sheet 92. In particular rivets which ensure a permanent connection can be used as mounting elements 96. Alternatively, also screws can be used as mounting elements 96, which has the advantage that these can again be disconnected non-destructively and the position of the sheets 92 can be changed depending on the configuration of the automated teller machine 12.

Compared to the use of integrally formed stops according to the embodiments 1 to 3, the use of sheets 92 as stops 80 has the advantage that in the receiving compartments 16 no different elements have to be used but that the same elements, i.e. the same sheets 92, just have to be arranged at different positions, similar to the pins 60 in the receiving elements 52 to 58 of the cash box 18.

In addition, the use of metal sheets 92 has the advantage that these are designed very robustly and thus sufficient resistance is offered also when a cash box 16 is inserted with high force and the respective stop 80 is not destructed.

In the embodiment shown in FIG. 10, the two sheets 92 are sealed by means of a common plastic cable 86. For this, slots 98 through which the cable 86 is passed are provided in the wall 82 and in the sheets 92. Here too, it is achieved by means of this plastic cable 86 that it can be detected when a manipulation has been performed, i.e. when the position of at least one sheet 92 has been changed.

Figure 11:
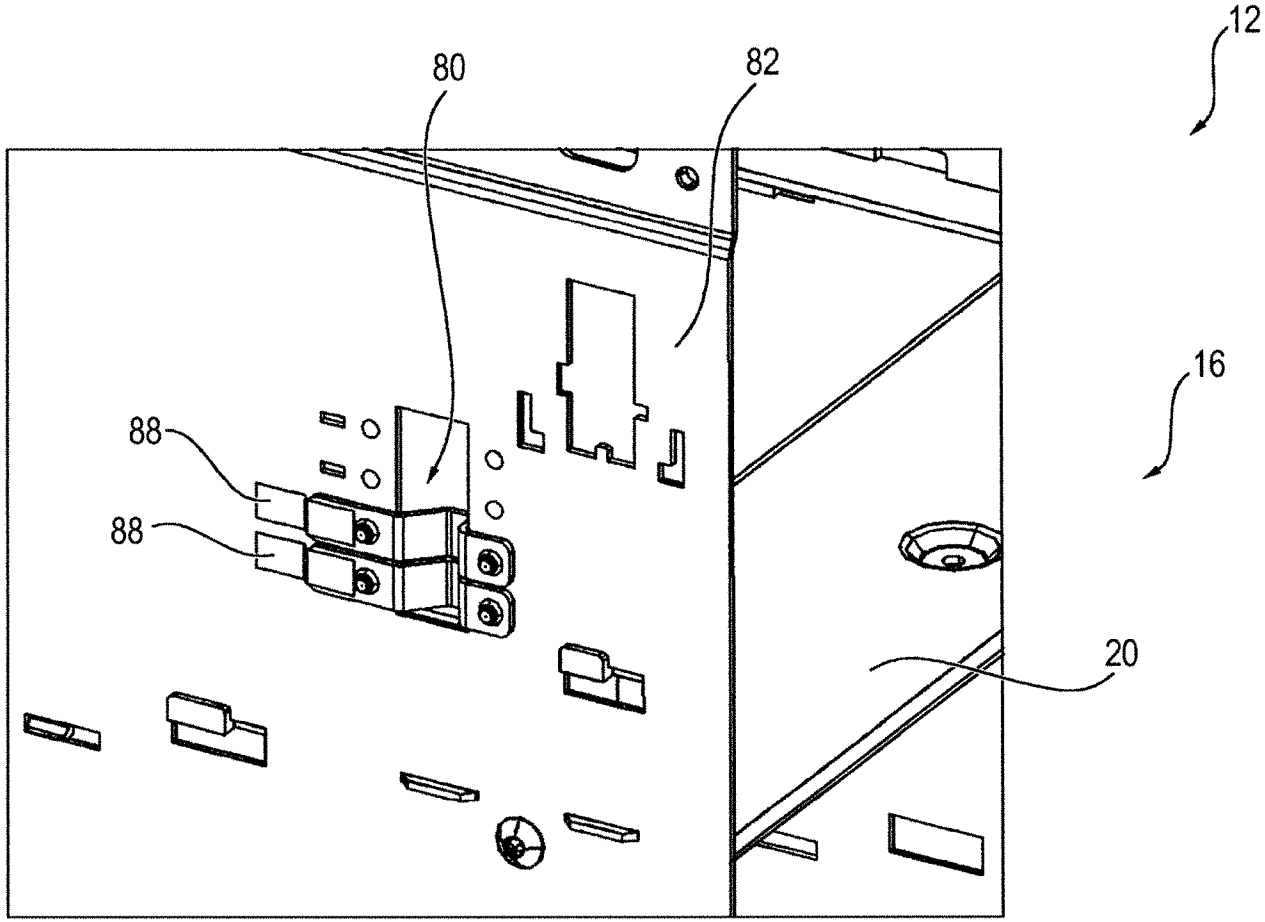
FIG. 11 shows a schematic perspective illustration of a detail of a receiving compartment according to a fifth embodiment.

In FIG. 11, a schematic perspective illustration of a detail of a receiving compartment 12 according to a fifth embodiment is illustrated. As in the fourth embodiment according to FIG. 10, here sheets 92 are used as stops 80. However, the fifth embodiment differs from the fourth embodiment in that the sealing is accomplished by means of perforated adhesive labels 88. Here, for each sheet 92 an own adhesive label 88 is provided. Alternatively, the sealing can also be accomplished by means of one common adhesive label 88, which adheres on a portion of both sheets 92.

Figure 12:
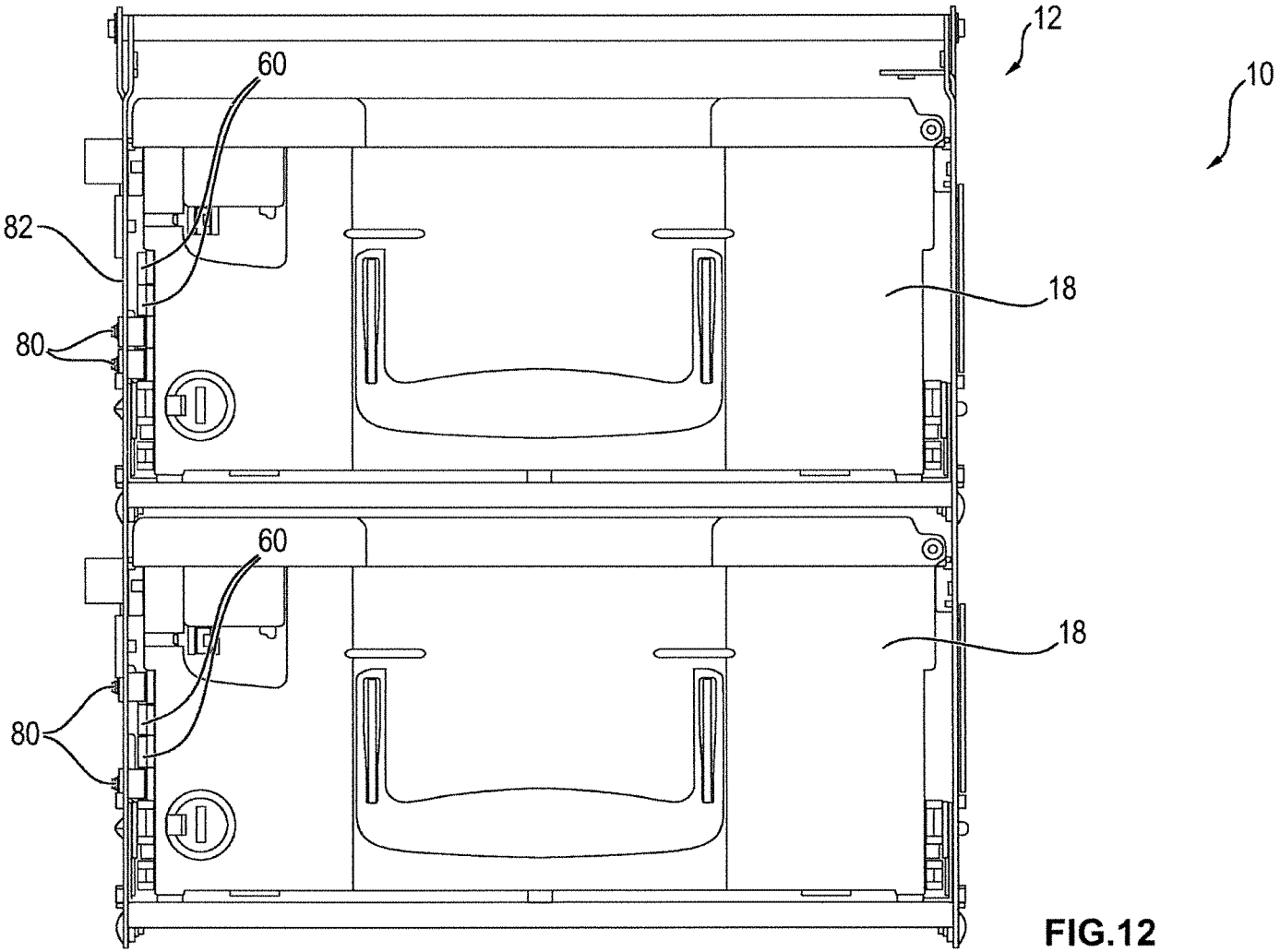
FIG. 12 shows a detail of an arrangement of a device for handling notes of value and two cash boxes.

In FIG. 12, a schematic illustration of a detail of an arrangement 10 comprised of a device 12 for handling notes of value and two cash boxes 18 which are inserted into receiving compartments 16 of the device 12 is shown. Here, for coding the receiving compartments 16 the fifth embodiment according to FIG. 11 is used.

In the upper receiving compartment 16 the two sheets 92, as in FIG. 11, are arranged in the lowest positions. The pins 60 are arranged in the two upper receiving elements 52, 54 accordingly so that the cash box 18 can be inserted into the upper receiving compartment 16.

In the lower receiving compartment, on the other hand, one of the sheets 92 is arranged in the uppermost position and the other sheet 92 is arranged in the lowest position. The pins 60 are correspondingly arranged in the two medium receiving elements 54, 56 in the case of the inserted cash box 18.

If one were to try to insert the lower cash box 18 into the upper receiving compartment 16 or, vice versa, the upper cash box 18 into the lower receiving compartment 16, then this would not work since the pins 60 would hit against the sheets 52 so that an insertion would be prevented.

Alternatively, it is also possible in all embodiments that more or less than four receiving elements 52 to 58 are provided so that correspondingly more or less than four different positions of the pin 60 can be set and thus an unambiguous coding is also possible in the case of devices 12 having more or less than four receiving compartments 16.

Further, in an alternative embodiment also two pins 60 or more than two pins 60, for example three pins 60, can be used. By using two pins 60 in the case of four receiving elements 52 to 58 six different codings can be achieved. When using more than four receiving elements 52 to 58, the number of possible codings can be increased further.

Here, it is not inevitably necessary that for each receiving compartment 16 of an automated teller machine a different coding is used. In particular, to each denomination a different coding is assigned, i.e. that when in an automated teller machine several cash boxes 18 of the same denomination are inserted, the coding elements 60 of these cash boxes 18 are arranged in the same position since in this case it does not matter which cash box 18 is inserted into which of the receiving compartments 16 of the automated teller machine 18 provided for the reception of the corresponding denomination. Accordingly, also the stops 80 in the receiving compartments 16 in which the same denomination is to be inserted are designed identically.

LIST OF REFERENCE SIGNS

10 arrangement
12 device
14 box receiving area
16 receiving compartment
18 cash box
20 rack
21 separating and/or stacking module
22 transport path
24 input and/or output compartment
30 receiving area
32 housing
34 recess
36 projection
50 coding unit
52, 54, 56, 58 receiving element
60 pin
62, 64 section
66 groove
68 locking element
80 stop
82 wall
84 projecting element
86 plastic cable
88 adhesive label
90 recess
92 sheet
94 hole
96 mounting element
98 slot

The invention claimed is:

1. A cash box comprising:

a housing having opposite front and rear ends spaced apart along an inserting direction of the cash box into a selected one of plural receiving compartments of a device, the housing further having opposite side walls extending between the front and rear ends, a bottom and an open or openable top opposite the bottom, the top and the bottom being spaced apart along a height direction;

a receiving area configured to receive a value note stack, and a mechanical coding unit including a coding element that is mounted to the housing in a first position along the height direction on at least one of the side walls of the housing or at least a second position along the height direction on at least one of the side walls of the housing, and the coding element being designed so that the cash box is only feedable to a first of the receiving compartments when the coding element is in the first position, and so that the cash box is only feedable to a second of the receiving compartments when the coding element is in the second position.

2. The cash box of claim 1, wherein the coding element, in the first position, mechanically prevents insertion of the cash box into any of the receiving compartments other than the first receiving compartment.

3. The cash box of claim 2, wherein the coding element in the second position mechanically prevents an insertion of the cash box into any of the plural receiving compartments other than the second receiving compartment.

4. The cash box of claim 1, wherein the housing of the cash box has at least one recess disposed and configured for receiving at least one rail of the receiving compartment so that engagement of the rail in the recesses achieves a predetermined relative positioning of the cash box in the respective receiving compartment.

5. The cash box of claim 1, wherein the coding element comprises at least one pin, and the housing of the cash box has a first receiving element for receiving the pin and a second receiving element for receiving the pin, wherein in the first position the pin is inserted into the first receiving element and partly projects therefrom and in the second position the pin is inserted into the second receiving element and partly projects therefrom.

6. The cash box of claim 5, wherein that the housing further has a third and a fourth receiving element for receiving the pin, the pin is arranged in a third position when the pin is inserted into the third receiving element, the pin is arranged in a fourth position when the pin is inserted into the fourth receiving element, that the cash box is only feedable to a third receiving compartment of the device when the pin in the third position and the cash box is only feedable to a fourth receiving compartment of the device when the pin is in the fourth position.

7. The cash box of claim 6, wherein the pin is a first pin, the coding element further comprising a second pin, the second pin is inserted into the second receiving element in the first position, into the third receiving element in the second position, into the fourth receiving element in the third position and into the first receiving element in the fourth position, and in a fifth position the first pin is inserted into the first receiving element and the second pin is inserted into the third receiving element and in a sixth position the first pin is inserted into the second receiving element and the second pin is inserted into the fourth receiving element.

8. The cash box of claim 6, wherein the first receiving element, the second receiving element, the third receiving element and/or the fourth receiving element are through holes in the at least one side wall such that an end portion of the pin projects into an interior of the cash box when the pin is inserted into the respective through hole.

9. The cash box of claim 8, further comprising a locking element, at the end portion of the pin or the pins projecting into the interior, the locking element being configured to prevent a removal of the pin from the receiving element without access to the interior in an assembled state.

10. The cash box of claim 9, wherein a groove is formed in the end portion of the first pin and/or the end portion of the second pin and a locking ring is arranged in the groove to define the locking element.

11. The cash box of claim 5, wherein each of the receiving elements is a through hole, the first pin and/or the second pin each have a first section with a first diameter and a second section with a second diameter, the second diameter is smaller than the first diameter, the second section is at least in part arranged in the through hole, the first diameter is larger than the diameter of the through hole, and at least part of the first section projects out from the side wall of the housing.

12. The cash box of claim 1, wherein the coding unit is a first coding unit, and the cash box further comprising at least a second coding unit that is constructed substantially identically to the first coding unit and/or is arranged at an opposite side of the housing.

13. A device for handling notes of value, comprising:

first and second receiving compartments provided respectively with first and second stops, first and second cashboxes provided respectively with first and second housings configured to be inserted into either of the first or second receiving compartments, a first coding element mounted along the height direction on at least one of the side walls of the first housing in one of at least first and second positions and being configured to hit against the first stop in an attempt of inserting the first cash box into the first receiving compartment when the first coding element is arranged in the first housing in a position other than the first position so that the first cash box cannot be inserted into the first receiving compartment when the first coding element is arranged in a position other than the first position, and a second coding element mounted along the height direction on at least one of the side walls of the second housing in one of at least first and second positions and being configured to hit against the second stop in an attempt of inserting the second cash box into the second receiving compartment when the second coding element is arranged in a position other than the second position so that the second cash box cannot be inserted into the second receiving compartment when the second coding element is arranged in a position other than the second position.

14. The device of claim 13, wherein the first stop and the second stop each comprise an element projecting into the receiving area of the respective receiving compartment, that the first stop has a first recess and the second stop has a second recess, that the first recess is designed so that either of the cash boxes is insertable into the first receiving compartment when the respective coding element is in the first position, the respective coding element is movable through the first recess of the first stop when the respective cash box is inserted into the first receiving compartment and that the second recess is designed so that either of the cash boxes is insertable into the second receiving compartment when the respective coding element is arranged in the second position, the respective coding element being movable through the second recess of the second stop when the cash box is inserted into the second receiving compartment.

15. The device of claim 13, wherein the first stop and/or the second stop each comprise at least a first sheet that is bent to project into the respective receiving compartment.

16. The device of claim 15, wherein the first stop and/or the second stop each further comprise at least a second sheet that is bent to project into the respective receiving compartment.

17. The device of claim 16, wherein at least one wall of the first receiving compartment and/or the second receiving compartment each has a recess and that the respective first sheet and/or the respective second sheet is mounted to the wall at a side thereof facing away from the receiving compartment and projects into the respective receiving compartment through the recess.

18. The device of claim 17, wherein the sheets are screwed and/or riveted to the wall.

19. The device of claim 18, wherein the wall of each receiving compartment has a predetermined number of holes via which the sheets can be mounted at different predetermined positions.

20. The device of claim 19, wherein eight holes per receiving area are provided by which four positions are defined.

21. The device of claim 19, wherein the number of different predetermined positions for mounting the sheets per receiving area is equal to the number of receiving elements for receiving the pins per cash box.

22. The device of claim 21, wherein the positions for mounting the sheets and the receiving elements are unambiguously assigned to each other.

23. The device of claim 13, wherein the first stop is mounted to a wall of the first receiving compartment and/or the second stop is mounted to a wall of the second receiving compartment, and wherein a seal is provided at the first stop and the wall of the first receiving compartment and/or at the second stop and the wall of the second receiving compartment so that a change of the position of the first stop relative to the wall of the first receiving compartment and/or a change of the position of the second stop relative to the wall of the second receiving compartment is determinable.

24. The device of claim 23, wherein the seal comprises a lead seal, an adhesive label, and/or a plastic cable.

25. The device of claim 23, wherein the seal has at least one predetermined breaking point.

26. The device of claim 13, wherein the first stop and/or the second stop each are made of a metal.

* * * * *